US006848196B2

(12) United States Patent
Brülls

(10) Patent No.: US 6,848,196 B2
(45) Date of Patent: Feb. 1, 2005

(54) METHOD OF MONITORING A FREEZE DRYING PROCESS

(75) Inventor: Mikael Johan Alvin Brülls, Molndal (SE)

(73) Assignee: AstraZeneca AB, Sodertalje (SE)

( * ) Notice: Subject to any disclaimer, the term of this patent is extended or adjusted under 35 U.S.C. 154(b) by 0 days.

(21) Appl. No.: 10/257,908

(22) PCT Filed: Apr. 17, 2001

(86) PCT No.: PCT/GB01/01731

§ 371 (c)(1),
(2), (4) Date: Oct. 17, 2002

(87) PCT Pub. No.: WO01/79773

PCT Pub. Date: Oct. 25, 2001

(65) Prior Publication Data

US 2003/0116027 A1 Jun. 26, 2003

(30) Foreign Application Priority Data

Apr. 19, 2000 (SE) ..... 0001453

(51) Int. Cl.[7] ..... F26B 5/06
(52) U.S. Cl. ..... 34/284; 34/268; 34/420
(58) Field of Search ..... 34/420, 284, 266, 34/268, 285; 426/384

(56) References Cited

U.S. PATENT DOCUMENTS

| | | | | |
|---|---|---|---|---|
| 3,020,645 A | | 2/1962 | Copson | |
| 3,271,874 A | | 9/1966 | Oppenheimer | |
| 3,812,596 A | | 5/1974 | Wilmanns | |
| 4,612,200 A | | 9/1986 | Sato | |
| 4,906,106 A | * | 3/1990 | Kaufmann et al. | 374/131 |
| 5,258,825 A | * | 11/1993 | Reed et al. | 356/402 |
| 5,319,200 A | * | 6/1994 | Rosenthal et al. | 250/349 |
| 5,976,466 A | * | 11/1999 | Ratner et al. | 422/82.11 |
| 6,097,588 A | * | 8/2000 | Zheng et al. | 361/503 |
| 6,342,259 B1 | * | 1/2002 | Wesley et al. | 426/231 |
| 6,643,950 B2 | * | 11/2003 | Lambert et al. | 34/286 |

FOREIGN PATENT DOCUMENTS

FR 2 587 464 A1 9/1985

OTHER PUBLICATIONS

Bardat et al., "Moisture measurement: A new method for monitoring freeze drying cycles", Journal of Parenteral Science and Technology, vol. 47, No. 6, 293–299.

Connelly et al., "Monitor Iyophilizaton with mass spectrometer gas analysis", Journal of Parenteral Science and Technology, vol. 47, No. 2, 70–75.

* cited by examiner

*Primary Examiner*—Henry Bennett
*Assistant Examiner*—Kathryn S. O'Malley
(74) *Attorney, Agent, or Firm*—Fish & Richardson P.C.

(57) ABSTRACT

A method of monitoring a freeze-drying process in an apparatus (1) holding one or more samples (9) of a material to be freeze dried, comprises the steps of directing input radiation onto the sample (9), the input radiation forming output radiation by interaction with the sample (9); collecting at least part of the output radiation and leading the thus collected radiation to a radiation analyzer (11); and analyzing the collected radiation spectroscopically in the radiation analyzer (11) to obtain a measurement value of one or more freeze-drying parameters of the sample (9), such as the temperature of the sample (9) and/or the content of a solvent in the sample (9) and/or the structure of the sample (9).

35 Claims, 5 Drawing Sheets

METHOD OF MONITORING A FREEZE DRYING PROCESS

CROSS REFERENCE TO RELATED APPLICATIONS

The present application is a national phase application under 35 U.S.C. Section 371 filed from International Patent Application PCT/GB01/01731 filed 17 Apr. 2001, which claims priority to Swedish patent application Serial. No. 0001453-0, filed 19 Apr. 2000. The contents of these applications are incorporated herein by reference in their entirety.

The present invention relates to freeze drying, and specifically to a method of monitoring a freeze-drying process in an apparatus holding one or more samples of a material to be freeze dried.

TECHNICAL BACKGROUND

Freeze drying or lyophilisation is a well known method for stabilization of otherwise easily degradable material, such as micro-organisms, food items, biological products and pharmaceuticals. In the field of pharmaceuticals, freeze drying is for example used in the production of injectable dosage forms, diagnostics, and oral solid dosage forms. Freeze drying is also suited for aseptic treatment of a material, since the material can be handled at sterile conditions until it is freeze dried into the final product.

A conventional freeze-drying apparatus, such as the one disclosed in U.S. Pat. No. 4,612,200, comprises a vacuum chamber in which the material to be freeze dried is placed. The apparatus also comprises heater means, such as IR heaters irradiating the material in the chamber, and pump/valve means controlling the pressure in the chamber. During the freeze-drying process, the temperature of the material is monitored by thermocouples arranged in contact with the material, which is distributed in samples within the vacuum chamber. This approach has certain drawbacks. First, the thermocouple will act as a site for heterogeneous nucleation and thereby influence the freezing behavior, resulting in different ice structure and subsequent drying behavior between monitored and non-monitored samples. Relative to the monitored samples, the non-monitored samples will also have a somewhat lower temperature and demand a different drying time. Second, the use of thermocouples in contact with the material is unsuitable for aseptic processing. Third, automatic loading and unloading of the material in the vacuum chamber might be difficult, since the thermocouples must be inserted physically into the material.

It also known to monitor the moisture content in the vacuum chamber during the freeze-drying process. In the article "Moisture measurement: A new method for monitoring freeze-drying cycles" by Bardat et al, published in the Journal of Parenteral Science and Technology, No 6, pp 293–299, the moisture content in the vacuum chamber is measured by means of one or more pressure gauges or a hygrometer. In the article "Monitor lyophilization with mass spectrometer gas analysis" by Connelly et al, published in the Journal of Parenteral Science and Technology, No 2, pp 70-75, the moisture content in the vacuum chamber is measured by means of a mass spectrometer. These prior art techniques are indirect and as such capable of identifying a suitable overall end point of the freeze-drying process, but the moisture content of the material itself cannot be readily assessed during the freeze-drying process. Further, the relationship between measurement response and actual moisture content of the material has to be established empirically for each type of material and freeze-drying apparatus, which is a laborious task in production scale. Also, these indirect measurements require a low and constant leak rate of the vacuum chamber, necessitating frequent leak rate tests. This is a particular problem when high-temperature sterilization is employed inside the vacuum chamber, for example by means of steam treatment, since it is common for the high sterilization temperatures to cause leaks.

SUMMARY OF THE INVENTION

The object of the invention is to solve or alleviate some or all of the problems described above. More specifically, it is an object to provide a method allowing for continuous monitoring of one or more freeze-drying parameters during one or more steps of the freeze-drying process, with minimum influence on the material to be freeze dried.

It is also an object of the invention to provide a method of monitoring that allows for automatic loading and unloading of the material in the freeze-drying apparatus.

A further object of the invention is to provide a method of monitoring that allows for aseptic conditions in the freeze-drying apparatus.

Another object of the invention is to provide a method of monitoring that is essentially unaffected by leaks in the freeze-drying apparatus.

These and other objects, which will appear from the description below, are achieved by the method set forth in the appended independent claims. Preferred embodiments are defined in the dependent claims.

The method according to the present invention allows for direct monitoring one or more freeze-drying parameters in the material itself during the freeze-drying process, or at least part thereof. The parameters that can be monitored include parameters related to physicochemical properties of the sample, such as temperature, structure, and content. The freeze-drying parameter or parameters can be monitored without influencing the sample or compromising the sample integrity. If desired, physical contact with the sample can be avoided in carrying out the method of the present invention, which consequently is well suited for aseptic processing. Furthermore, the method can be effected in real time, and the monitored parameter or parameters can be used for feedback control of the freeze-drying process, in order for the final freeze-dried product to exhibit defined quality characteristics, for example specified content, visual appearance, or structure.

In one preferred embodiment, the collected radiation comprises input radiation that has been diffusely reflected on the sample. In this case, the intensity of the collected radiation will depend on both the scattering properties and the absorption properties of the sample. This allows for monitoring of the macroscopic structure, the morphology, of the sample as well as the temperature of the sample and the content of a solvent in the sample. In addition, other structure can be monitored, such as the degree of crystallinity and polymorphism of the sample, as well as further physical and/or chemical properties thereof. According to a further preferred embodiment, the input radiation and the collected radiation are led to and from the sample by one and the same radiation-transmitting means, such as an optical fiber assembly. This provides for ease of installation, and necessitates only minimum redesign of existing freeze-drying apparatus. Preferably, the analysis is made in the near infrared (NIR) wavelength region of the collected radiation, since generally the absorption from the bulk material is low in this wavelength region such that the input radiation penetrates the sample to some extent. Thus, the collected radiation will contain information from the bulk of the sample, not only from the surface thereof. From a practical point of view, NIR radiation can be easily produced by halogen lamps and transported by optical fibers.

In addition to the solution to the above-mentioned problems, the invention or its embodiments confer the following advantages, which cannot be readily obtained with prior-art technique.

In the initial freezing step, an annealing operation is sometimes required in order to eliminate any eutectic formed during the freezing step. In an annealing operation, the material is first frozen to allow for solidification, then heated to a predefined temperature for a given time and then cooled again in one or more steps. In such an annealing operation, contact with the sample should be avoided. By the method of the invention, this annealing operation can be monitored, and optionally controlled, via a parameter related to the structure or the temperature of the sample.

The end point of the sublimation step can be determined.

In the sublimation and desorption steps, the sublimation rate and the drying rate, respectively, can be continuously monitored.

Deviations from normal in the macroscopic structure of the material, or in the degree of crystallinity or polymorphism thereof, can be detected at an early stage.

BRIEF DESCRIPTION OF THE DRAWINGS

The invention will now be described in more detail with reference to the accompanying, schematic drawings.

DESCRIPTION OF PREFERRED EMBODIMENTS

Figure 1:
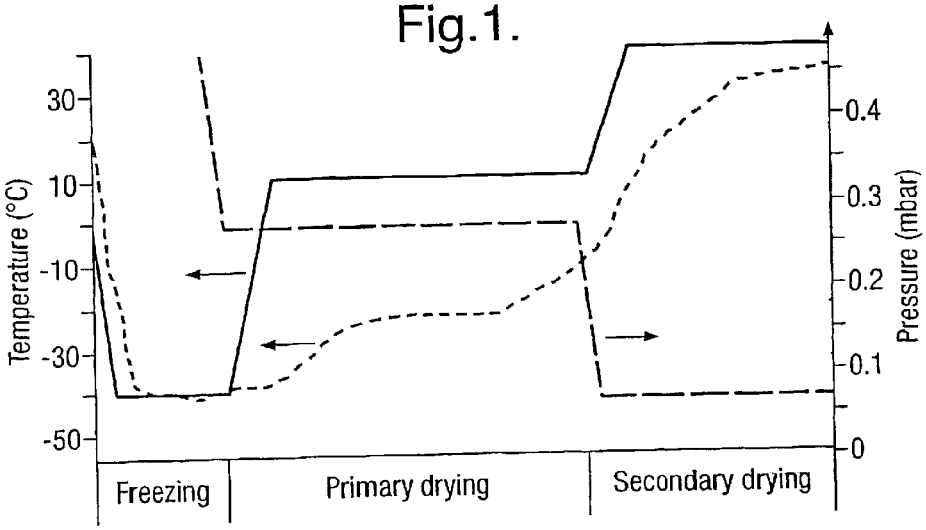
FIG. 1 is a diagram showing the variation of sample temperature, chamber pressure and shelf temperature during a typical freeze-drying process, as measured by conventional means.

First, a freeze-drying process will be generally described with reference to FIG. 1 which shows an example of the variation of product temperature (dotted line) and chamber pressure (dashed line) over time during a freeze-drying process in a conventional freeze-drying apparatus, as monitored by conventional thermocouples and a pressure gauge, respectively. The diagram of FIG. 1, was recorded in a freeze-drying apparatus in which the samples of the material to be freeze dried are placed on shelves in the vacuum chamber and are heated by means of temperature-controlled silicone oil flowing through the shelves. In FIG. 1, the shelf temperature (continuous line) is included for reference. Generally, the freeze-drying process includes three main steps: freezing, sublimation (also called primary drying), and desorption (also called secondary drying). In the initial freezing step, the chamber pressure is at atmospheric level and the temperature in the chamber is reduced to allow for solidification of the material. In the following sublimation step, the chamber is evacuated until the pressure is less than the vapor pressure of ice at the present temperature of the material and the material is heated to provide the energy required for sublimation of ice. This step is terminated when all of the ice in the material has been removed. In the ensuing desorption step, the chamber pressure is reduced while the temperature of the material is increased, to remove any water being adsorbed to or trapped by the solid matrix of the material.

Figure 2A:
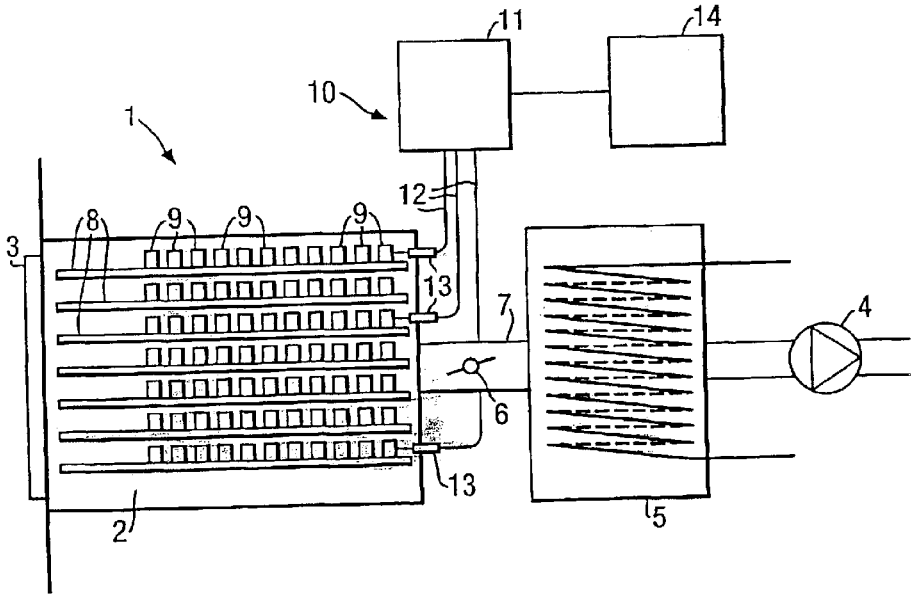
FIG. 2*a* illustrates an embodiment in which radiation is led to and from each sample by one optical probe for monitoring the freeze-drying process, wherein the samples are arranged in a freeze-drying apparatus of conventional design.

FIG. 2*a* shows one type of conventional freeze-drying apparatus 1. Although the following description is given with regard to this apparatus, the method according to the invention can be applied in any kind of freeze-drying apparatus during processing of any kind of material. The apparatus 1 of FIG. 2*a* comprises a vacuum chamber 2 which is accessible through a door 3, and a vacuum pump 4 which is connected to the chamber 2 via a condenser 5. A control valve 6 is arranged in a conduit 7 between the chamber 2 and the condenser 5 to selectively open and close the conduit 7. The vacuum chamber 2 is provided with shelves 8 on which samples 9 of the material to be freeze dried can be placed. The vacuum chamber 2 also comprises one or more heaters (not shown) capable of changing the temperature of the material placed on the shelves. The operation of the disclosed apparatus 1 will not be further described, since it is not essential to the invention.

In FIG. 2*a*, the apparatus 1 is provided with a monitoring system 10 operating by reflection spectroscopy according to an embodiment of the present invention. In the disclosed embodiment, radiation is generated in a radiation analyzer 11 and transmitted to the sample 9 in the freeze-drying apparatus 1 via one or more optical fiber probes 12. The incident radiation is directed onto the sample 9, whereupon radiation diffusely reflected from the sample 9 is collected by the same optical fiber probe 12 and carried back to the radiation analyzer 11 where it is analyzed spectrally to obtain a measurement value related the sample 9, as will be further described below. Here, a back-scattering geometry is used, i.e. radiation is directed to and collected from the sample 9 from one and the same location relative to the sample 9. Each optical fiber probe 12 is guided through a wall portion of the vacuum chamber by means of a respective holder 13.

As shown in FIG. 2*a*, the radiation analyzer 11 is connected to a processing unit 14, which is adapted to receive and store measurement data from the radiation analyzer 11 for each batch that is being processed in the freeze-drying apparatus 1. Optionally, the processing unit 14 could be adapted to effect an in-line control of the freeze-drying process in the apparatus 1, for example by selectively activating the pump 4 and/or valve 6 and the heaters (not shown), respectively, based on the measurement data provided by the radiation analyzer 11.

Figure 2B:
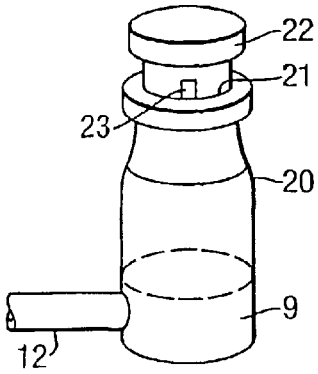
FIG. 2*b* illustrates the arrangement of the optical probe in the vicinity of a sample within the freeze-drying apparatus of FIG. 2*a*.

In FIG. 2*b*, the sample 9 to be monitored is confined to a container 20. The container 20 is of course necessary when the sample 9 initially is in a liquid state, but could also be employed whenever the sample 9 should be processed under aseptic conditions. The container or vial 20 has an opening 21 which is sealable by means of a plug 22. The plug 22 has an open slit 23 at its end to be inserted into the opening of the container 20. When a batch of containers 20 are fed into the freeze-drying apparatus 1, the plugs 22 are arranged in the container openings 21, but are not fully inserted therein. Thus, the interior of the container 20 communicates with the vacuum chamber 2 to allow water to escape from the sample 9. After completion of the freeze-drying process, the containers 20 are sealed by pushing the plugs 22 further into the container openings 21. This can be done mechanically in an automated fashion.

As shown in FIG. 2*b*, the optical fiber probe 12 is arranged outside the container 20, the distal end of the probe being arranged close to, or against, a wall portion of the container 20. The container 20 is made of a material, for example glass, that is transparent to radiation in the relevant wavelength range. Thus, direct contact between the probe 12 and the sample 9 in the container 20 is avoided. Nevertheless, if desired in a particular application, the probe can 20 be arranged in direct contact with the sample 9.

Each optical probe 12 can consist of a single optical fiber or a bundle of such optical fibers. Preferably, the radiation analyzer 11 is capable of analyzing radiation from several optical probes 12, so that the freeze-drying process of several samples 9 can be monitored simultaneously within each batch. Alternatively, such a radiation analyzer 11 with multiple probes can be used to further assess the homogeneity of a sample 9, by placing two or more optical probes 12 in association with one sample 9.

In one preferred embodiment, the radiation generated and analyzed by the radiation analyzer 11 comprises near infrared (NIR) radiation in the range corresponding to wavelengths of from about 700 to about 2500 nm.

In the radiation analyzer 11, the collected radiation is separated into its spectral components. This can be implemented in many different conventional ways, for example by the use of one or more single-channel detectors for selecting one or more wavelengths, such as ultrafast photo diodes, photomultipliers, etc; or by the use of a multi-channel detector. Use can be made of light dispersive systems, such as a spectrometer; a wavelength dependent beam splitter; a non-wavelength dependent beam splitter in combination with a plurality of filters for filtering each of respective components for providing radiation of different wavelength or wavelength band; a prism array or a lens system separating the emitted radiation from the sample into a plurality of components in combination with a plurality of filters, etc.

After dispersion of the collected radiation, the radiation analyzer 11 calculates one or more measurement values by comparing the radiation sent to and the radiation received from the sample 9 through the optical probe 12, in relation to corresponding data for a standard sample, normally a so-called white standard.

Figure 3A:
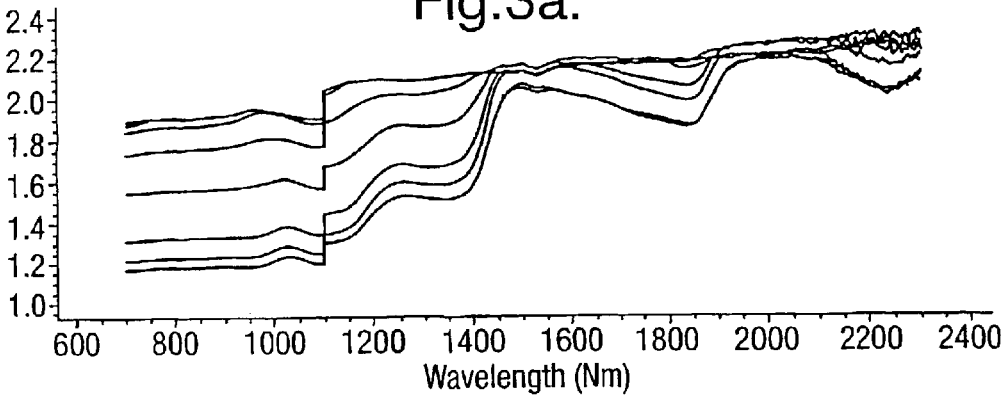
FIG. 3*a* shows spectrally resolved radiation in the NIR range collected from a sample during an initial freezing step.
Figure 4A:
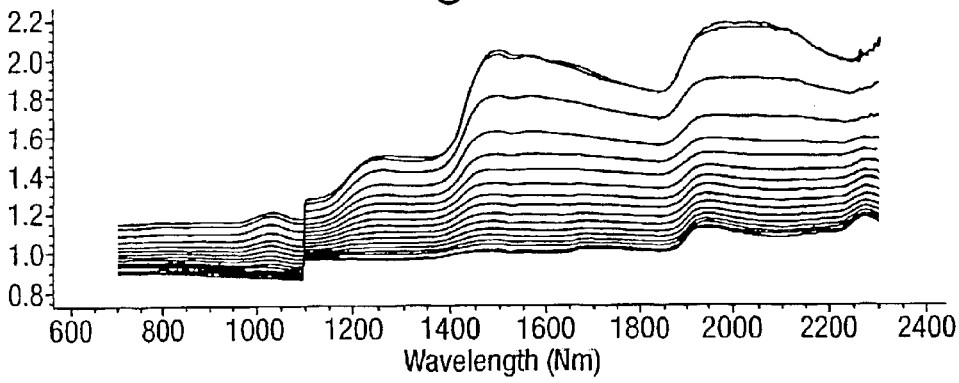
FIGS. 4*a* and 4*b* corresponds to FIGS. 3*a* and 3*b*, respectively, but is based on radiation collected during a sublimation step.
Figure 5A:
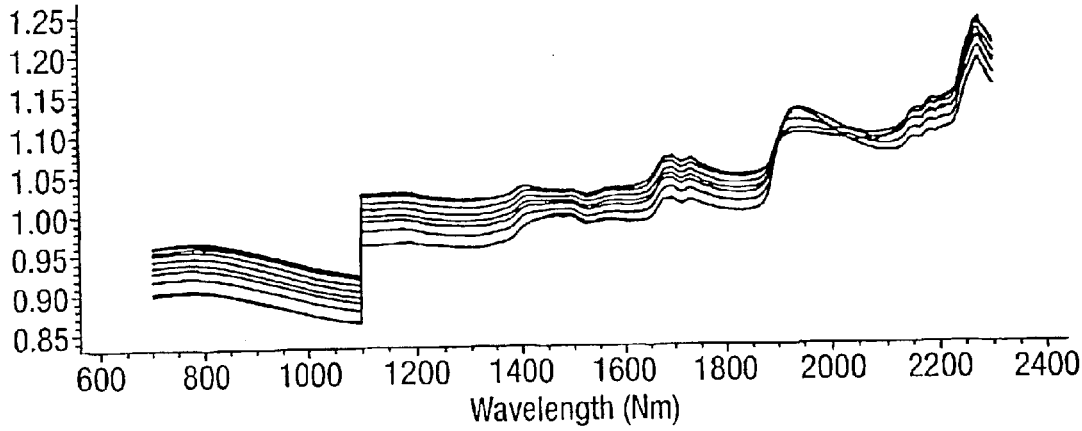
FIGS. 5*a* and 5*b* corresponds to FIGS. 3*a* and 3*b*, respectively, but is based on radiation collected during a desorption step.

FIGS. 3*a*, 4*a* and 5*a* show examples of spectrally dispersed radiation received from a sample during a freezing step, a sublimation step and a desorption step, respectively. Evidently, the intensity and the spectral shape of the collected radiation changes markedly during these steps. In these tests, a commercially available radiation analyzer (FOSS NIRSystems 6500 spectrometer) was used in conjunction with an optical fiber assembly (Optiprobe). Other tests have been made with equally satisfactory results using a multichannel FT-IR spectrometer (Bomem NetworkIR) in conjunction with several single-fiber probes.

The data evaluation can be done in different ways. A simple approach would be to pick out a single spectral band whose height or area may be correlated with the freeze-drying parameter of interest. This is often difficult to achieve due to complexity of the spectrum and a high degree of band superposition. In such cases, a large portion of the data in each spectrum can be used for the analysis, for example based on chemometric methods.

In a first variant, the spectrum of the collected radiation is condensed into one or more values by means of a Principal Component Analysis (PCA). In this way, the most abundant changes in the physicochemical properties of the sample can be monitored. The underlying spectral changes are then given in the respective loading vectors which can be compared to reference values for interpretation of the changes in the physicochemical properties of the samples as a result of the evolvement of the freeze-drying process.

In a second variant, a multivariate calibration can be conducted through correlation to reference measurement data, such as content, temperature, macroscopic structure, degree of crystallinity or polymorphism of the sample. This multivariate calibration results in a calibration model. When new measurements are performed, the model can be used to predict the desired measurement values of the unknown sample.

Figure 3B:
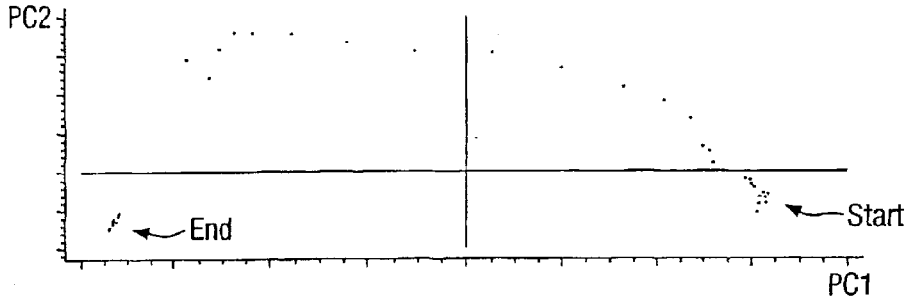
FIG. 3*b* is a plot resulting from a Principal Component analysis of the data in FIG. 3*a*.
Figure 4B:
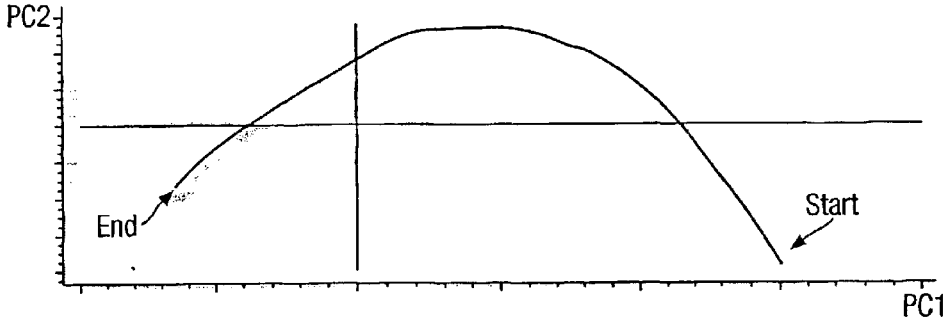
Figure 5B:
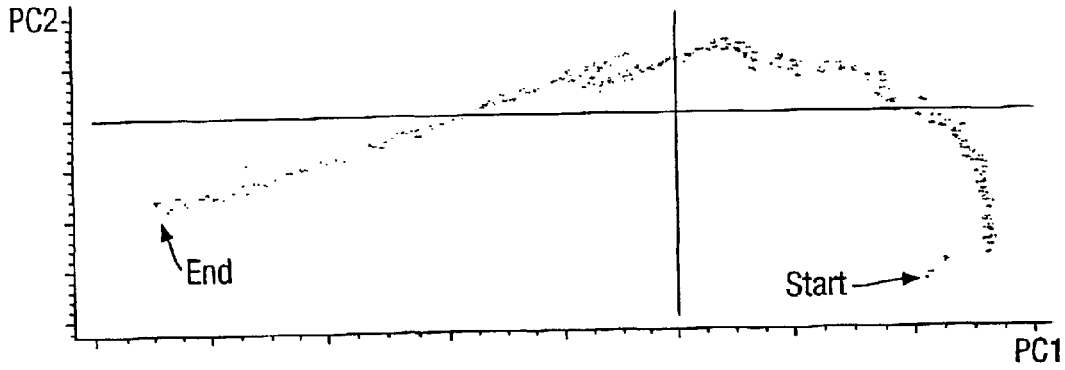

FIGS. 3*b*, 4*b* and 5*b* shows the result of an analysis in accordance with the first variant, as discussed above, in which the freeze-drying process is monitored in relative terms only, for example to detect a suitable end point for each process step or detect deviations from normal with respect to the structure of the sample. Here, the measurement value is extracted as one or more principal components by means of a Principal Component Analysis of the spectrum of the collected radiation. During the freeze-drying process, the extracted measurement values follow a trajectory in a space defined by the one or more principal components (PC1, PC2). By comparing this trajectory with a reference trajectory, a suitable end point of the different process steps can be identified as well as deviations from normal.

Figure 6:
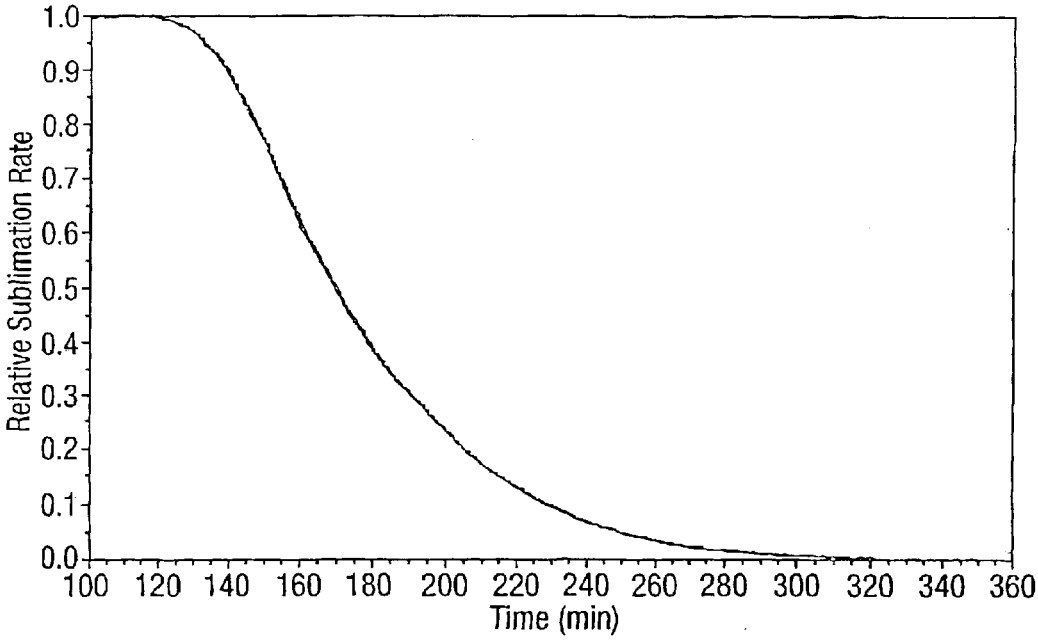
FIG. 6 shows a sublimation rate of a sample during a sublimation step, the sublimation rate being extracted from data similar to those presented in FIG. 4*a*.

FIG. 6 shows an example of a relative sublimation rate calculated from data similar to those displayed in FIG. 4*a*. Here, a time-series of collected spectra was subjected to a principal component analysis, and the resulting first principal component was used as a measurement value related to the water content of the sample. The relative sublimation rate was calculated as the ratio between the measurement value at a given time and the total change in the first principal component during the sublimation step (from 100 min to 360 min), the sublimation rate being offset to attain a value of 1 at the beginning of the sublimation step.

It should be realized that the information on temperature, moisture content, macroscopic structure, degree of crystallinity or polymorphism can be extracted in other ways than those described, for example by using another technique of condensing the data content of the spectrum, optionally based on a specific portion of the spectrum.

Evidently, the above-described method can be used to monitor, in one and the same measurement, characteristics of the sample itself that are important for the final quality of the product.

Without limiting the invention thereto, the method can be used to determine the end point of the ice formation process in the initial freezing step, monitor an annealing process in the initial freezing step, determine the end point of the sublimation step, monitor the course of the sublimation step, monitor the sample temperature in the sublimation step, monitor the sublimation rate during the sublimation step, detect deviations from normal in the sublimation step, determine the end point of the desorption step, monitor the sample temperature in the desorption step, detect deviations from normal in the desorption step, monitor the drying rate during the desorption step etc.

The method of monitoring can be used in a preparatory study when designing a robust and stable program for controlling a freeze-drying process. However, the method is advantageously used in real time for feedback control of the freeze-drying process based on the extracted measurement values. By storing the measurement values for each batch, traceability is achieved which is important at least in the field of pharmaceuticals. Further, the method can be used for quality control of the product at the end of the freeze-drying process.

It is also to be understood that the inventive method can be applied in the freeze-drying of samples that are prepared with other solvents than water, e.g. methylenechloride, ethanol, buthylalcohol, etc.

The invention can also be implemented with radiation in another suitable wavelength range, e.g. IR, UV–VIS. Although the above-described embodiment is based on reflection spectroscopy, more precisely NIR spectroscopy, it is conceivable to use other spectroscopic techniques, for example based on transmission or transreflectance. Alternatively, Raman-scattering spectroscopy can be used, for example with radiation in the UV–VIS or NIR. The Raman-scattered radiation is responsive to the temperature, and the degree of crystallinity and polymorphism of the sample. The Raman-scattered radiation is also responsive, albeit to a lesser degree than reflection spectroscopy, to macroscopic structure and moisture content of the sample. To generate Raman-scattered output radiation, the input radiation need not be tuned to resonance with the material being freeze-dried. Thus, the wavelength range of the input radiation can be selected such that a desired penetration depth is obtained in the sample. As a further alternative, emission spectroscopy can be used, for example based on fluorescence emission. It is realized that the inventive method could be used with other radiation, such as ultrasonic waves, microwaves, NMR, or X-rays. It should also be understood that one spectroscopic technique can be combined with one or more conventional techniques or further spectroscopic technique(s).

What is claimed is:

1. A method of freeze-drying a sample in an apparatus holding one or more samples of a material to be freeze dried, said method comprising placing said one or more samples in freeze-drying apparatus, freeze-drying a said sample in said apparatus, characterized by the steps of directing input radiation onto the sample, said input radiation forming output radiation by interaction with the sample;

collecting at least part of said output radiation and leading the thus collected radiation to a radiation analyzer; and analyzing the collected radiation spectroscopically in the radiation analyzer to obtain a measurement value of one or more freeze-drying parameters of the sample.

2. A method according to claim 1, wherein said collected radiation comprises input radiation that has been diffusely reflected on the sample, and wherein said step of analyzing is at least partly based on said reflected input radiation.

3. A method according to claim 1, further comprising arranging a radiation-transmitting means in the vicinity of at least one of the samples prior to said directing, and wherein said directing involves said input radiation from said radiation-transmitting means onto the sample.

4. A method according to claim 3, wherein said collected radiation is led to said radiation analyzer through said radiation-transmitting means.

5. A method according to claim 3, wherein said radiation-transmitting means includes at least one optical fiber.

6. A method according to claim 3, wherein the sample is enclosed in a container, and said radiation-transmitting means directs said input radiation onto the sample through a wall portion of said container.

7. A method according to claim 3, wherein said radiation-transmitting means is in contact with said sample.

8. A method according to claim 1, wherein said measurement value is fed to a control unit, and wherein said control unit controls the freeze-drying process on the basis, at least partly, of said measurement value.

9. A method according to claim 8, wherein the freeze-drying process is controlled by operation of means effecting an adjustment of a total pressure and/or a temperature in the apparatus.

10. A method according to claim 1, wherein said input radiation comprises near infrared (NIR) radiation, and said collected radiation is analyzed spectroscopically in the near infrared wavelength region.

11. A method according to claim 1, wherein said input radiation and said collected radiation is led through several optical fibers to and from the sample, and wherein said radiation analyzer performs a separate analysis of the collected radiation led through each optical fiber to obtain a respective measurement value.

12. A method according to claim 1, wherein said one or more parameters are related to one or more physicochemical properties of the sample.

13. A method according to claim 1, wherein one of said freeze-drying parameters comprises a temperature of the sample.

14. A method according to claim 1, wherein one of said freeze-drying parameters comprises a content of a solvent in the sample.

15. A method according to claim 1, wherein one of said freeze-drying parameters corresponds to a structure of the sample.

16. A method according to claim 1, wherein the analysis in the radiation analyzer is based on a chemometric method.

17. A method according to claim 1, wherein the step of analyzing comprises the steps of generating a sample vector of data values, and condensing said data values into said measurement value.

18. A method according to claim 17, wherein each data value corresponds to an intensity of the collected radiation at a given wavelength.

19. A method according to claim 1, wherein said directing, collecting, and analyzing are carried out on a sample that is a final product in order to determine the quality of the freeze-dried material.

20. A method according to claim 1 wherein said one or more freeze-drying parameters include a temperature of the sample, and wherein said freeze drying includes a sublimation step, and wherein said directing and collecting occur during said sublimation step of the freeze-drying process.

21. A method according to claim 1 wherein said freeze-drying includes an initial freezing step, and wherein said directing and collecting occur during said initial freezing step, and wherein said analyzing includes determining an end point of the ice formation process in the sample during said initial freezing step of the freeze-drying process.

22. A method according to claim 1 wherein said freeze-drying includes an initial freezing step, and wherein said directing and collecting occur during said initial freezing step, and wherein said analyzing includes monitoring a structure of the sample during said initial freezing step of the freeze-drying process.

23. A method according to claim 1 wherein said freeze-drying includes an initial freezing step, and wherein said directing and collecting occur during said initial freezing step, and wherein said analyzing includes monitoring an annealing operation performed during said initial freezing step of the freeze-drying process, said annealing process being monitored via temperature and/or structure of the sample.

24. A method according to claim 1 wherein said freeze-drying includes a sublimation step, and wherein said directing and collecting occur during said sublimation step, and wherein said analyzing includes determining an end point of said sublimation step of the freeze-drying process.

25. A method according to claim 1 wherein said freeze-drying includes a sublimation step, and wherein said directing and collecting occur during said sublimation step, and wherein said analyzing includes monitoring a sublimation rate during said sublimation step of the freeze-drying process.

26. A method according to claim 1 wherein said freeze-drying includes a desorption step, and wherein said directing and collecting occur during said desorption step, and wherein said analyzing includes determining an end point of said desorption step of the freeze-drying process.

27. A method according to claim 1 wherein said freeze-drying includes a desorption step, and wherein said directing and collecting occur during said desorption step, and wherein said analyzing includes monitoring a drying rate during said desorption step of the freeze-drying process.

28. A method according to claim 1 wherein said freeze-drying includes a desorption step, and wherein said directing and collecting occur during said desorption step, and wherein said analyzing includes monitoring a content of a solvent other than water in the sample, at least during said desorption step of the freeze-drying process.

29. The method of claim 1 wherein said radiation includes near infrared radiation, and wherein near infrared spectroscopy (NIRS) is used during said analyzing to obtain a measurement value of one or more freeze-drying parameters related to one or more physicochemical properties of said at least one sample.

30. The method of claim 1, wherein said directing, collecting, and analyzing is before said freeze-drying.

31. The method of claim 1, wherein said directing, collecting, and analyzing is during said freeze-drying.

32. The method of claim 1, wherein said directing, collecting, and analyzing is after said freeze-drying.

33. The method of claim 14, wherein said solvent is water.

34. The method of claim 15, wherein said structure is a member of the group consisting of macroscopic structure, a degree of crystallinity, and polymorphism.

35. The method of claim 16, wherein said chemometric method is multivariate statistical analysis.

* * * * *